United States Patent [19]

Le Lan et al.

[11] Patent Number: 5,057,011

[45] Date of Patent: Oct. 15, 1991

[54] FURNACE GRATE ROLLER NAMELY FOR INCINERATING REFUSE WITH A TUBULAR CASING FORMED BY RINGS OF BARS SEPARATED BY BLOW GAPS OF SET WIDTH

[75] Inventors: André Le Lan, Marley-Le-Roi; José de Freitas, Carrieres-Sur-Seine, both of France

[73] Assignee: Fours Picard, Rueil-Malmaison, France

[21] Appl. No.: 527,829

[22] Filed: May 24, 1990

[30] Foreign Application Priority Data

May 25, 1989 [FR] France ..... 89 06852

[51] Int. Cl.[5] ..... F27D 3/00

[52] U.S. Cl. ..... 432/236; 432/246; 110/246; 110/276; 110/281

[58] Field of Search ..... 110/246, 257, 287, 288, 110/327, 328; 432/246, 236

[56] References Cited

U.S. PATENT DOCUMENTS

| | | | |
|---|---|---|---|
| 1,831,816 | 11/1931 | Magrath | 110/276 |
| 2,501,763 | 3/1950 | Denker et al. | 110/276 |
| 3,469,544 | 9/1969 | Kremer | 110/246 |
| 4,320,710 | 3/1982 | Steiner et al. | 110/281 |
| 4,537,139 | 8/1985 | Esser . | |
| 4,610,209 | 9/1986 | Temelli . | |

FOREIGN PATENT DOCUMENTS

| | | |
|---|---|---|
| 0124826 | 11/1984 | European Pat. Off. . |
| 0157920 | 10/1985 | European Pat. Off. . |
| 1164014 | 5/1962 | Fed. Rep. of Germany . |
| 3341835 | 5/1985 | Fed. Rep. of Germany . |
| 1286528 | 1/1962 | France . |

*Primary Examiner*—Henry C. Yuen

*Attorney, Agent, or Firm*—Young & Thompson

[57] ABSTRACT

A furnace grate roller, mainly for incinerating refuse, with a tubular casing formed by rings of bars separated by blow gaps of set width, is of conventional structure, comprising a cylindrical cage framework with T-shape cross-section longitudinal members disposed along its generatrices and a casing formed of groups of rings separated by gaps for blowing combustion-supporting air. The rings are segmented into arcuate bars which extend between the longitudinal members. To limit relative movement of the bars while allowing them some play the bars are attached at one end by a notch to the flange of a longitudinal member and are secured in place by bosses on an intermediate member bolted longitudinally to the longitudinal member. The bars have recesses at their end contiguous with the intermediate member into which the bosses are inserted. In this way the bars are attached with limited capacity for movement relative to the roller in the axial, radial and peripheral directions.

12 Claims, 2 Drawing Sheets

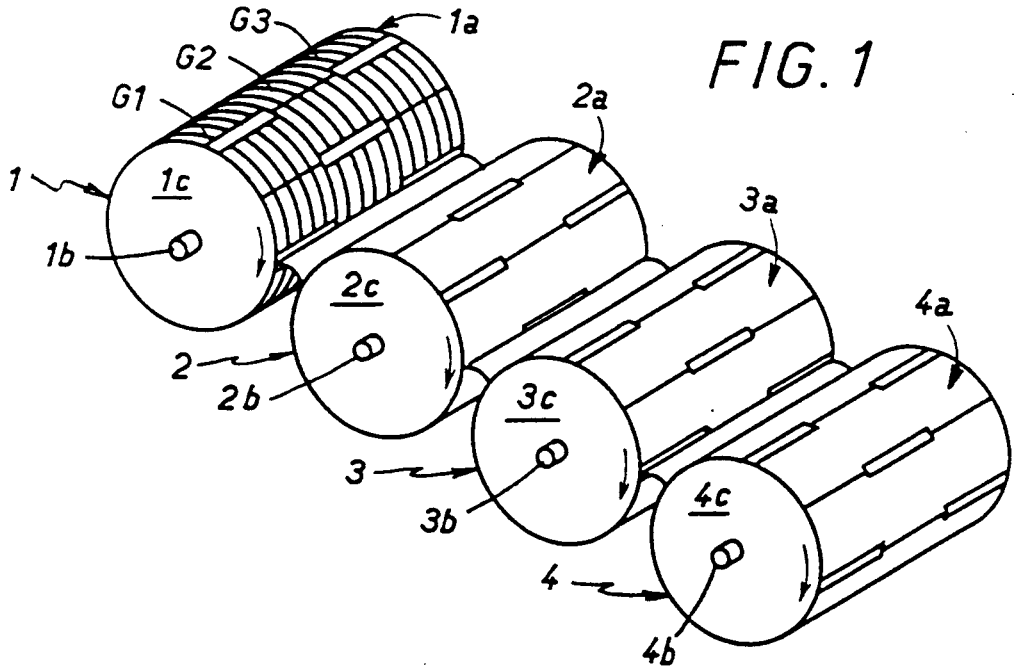
FIG. 1
FIG. 3
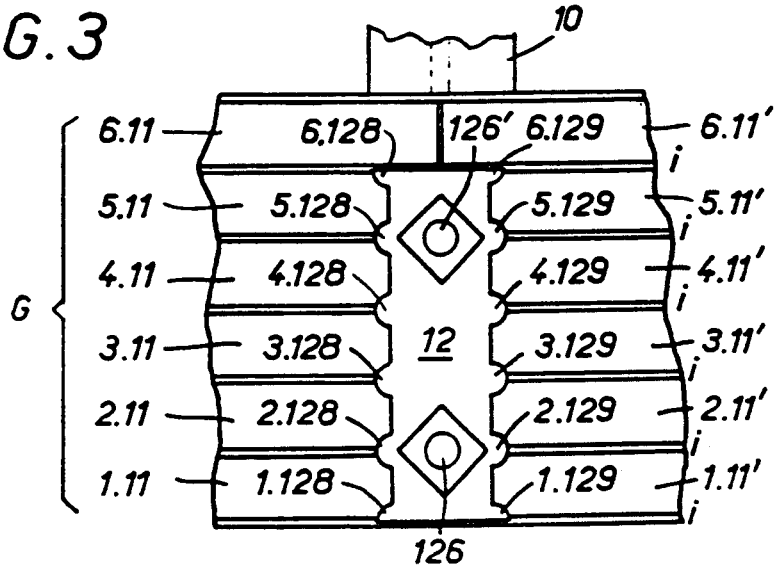
FIG. 2
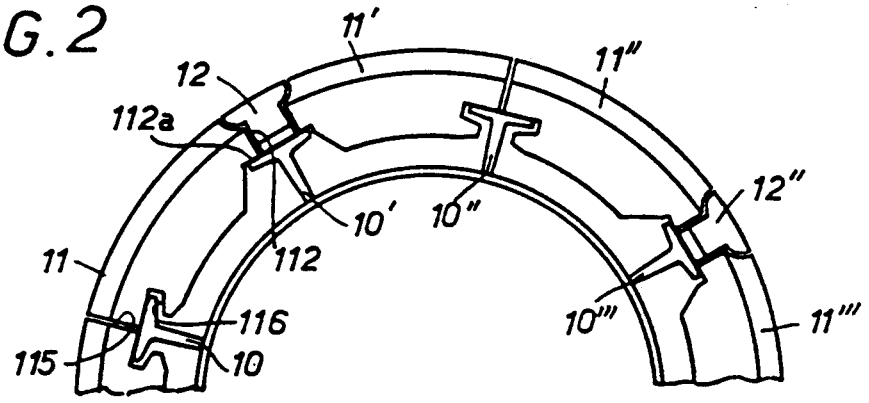

FURNACE GRATE ROLLER NAMELY FOR INCINERATING REFUSE WITH A TUBULAR CASING FORMED BY RINGS OF BARS SEPARATED BY BLOW GAPS OF SET WIDTH

The invention concerns a furnace grate roller intended mainly for incinerating refuse and comprising a cascade of rollers driven in rotation about parallel horizontal axes, each roller comprising a cylindrical cage framework with longitudinal members disposed between two flanges along generatrices regularly spaced around the periphery and a tubular casing formed by a plurality of groups of circular rings generally in planes perpendicular to the axis and in axial sequence from one flange to the other, gaps being provided between the rings for blowing combustion-supporting air, while the rings are segmented, comprising a plurality of arcuate bars which are mounted with play between two adjacent longitudinal members and intermediate members associated with the respective groups of rings are fixed to the longitudinal members so as to limit relative axial movement of the bars in the groups.

Furnace grates formed by a cascade of rollers are suitable for incinerating solid refuse, domestic garbage or industrial waste which has an erratic texture, a high moisture content and a relatively low calorific value, because they bring about displacement, loosening and turning over of the combustible layers descending the cascade and lend themselves to distributed blowing of combustion-supporting air at high rates of flow, favorable to drying of the refuse at the entry to the furnace and acceleration of combustion.

The document FR-A-1 286 528 includes a general description of a roller grate of this kind.

As in all furnace grates the members on which the combustible materials rest are subjected to very severe thermal stresses associated with heating due to radiation and to contact with the burning materials and with cooling due to the blowing of combustion-supporting air. The rollers therefore comprise a casing made up of refractory castings mounted with play on a supporting framework. Designing the casings for rotary grate rollers poses special problems, the casings being subjected to thermal cycles entailing heating in the furnace over almost half a revolution and cooling below the furnace during the remainder of the revolution. What is more, at the same time as they are driven in rotation by the roller, the casing members rotate on themselves relative to the vertical, i.e. the direction of their weight. They must be attached to the framework in such a way as to retain them in three perpendicular directions: axial, radial and peripheral or tangential.

The framework is usually a cylindrical cage construction (DE-C-1 164 014; DE-C-3 341 835; EP-A-0 124 826) with T-shape cross-section iron longitudinal members extending between end flanges along generatrices of the cage which are equi-angularly spaced, the webs of the longitudinal members being disposed in planes passing through the axis of the roller and directed towards this axis.

The casing members are usually annular segment-shape bars each extending between two adjacent longitudinal members and disposed in sequence around the periphery of the roller to form a ring in a plane perpendicular to the axis of the roller. The rings are disposed in sequence from one flange to the other and gaps for blowing combustion-supporting air are provided between successive rings, usually by virtue of the presence of bosses projecting from the sides of the bars. The contacting bosses of two axially contiguous bars therefore determine the minimum width of the gap.

According to the documents previously mentioned the bars have a T-shape cross-section perpendicular to the periphery of the ring with a web forming a rib directed towards the axis in a plane perpendicular to the axis while the flanges form the surface supporting the combustible mass. The bars are attached by providing at both ends of the web notches which fit around flanges of the longitudinal members. To fit the bars at least one flange is removed and the bars are threaded on parallel to the axis. Note however that the first bars may be offered up between the longitudinal members at an angle to a plane perpendicular to the axis so that the web of the bar, below the notches, passes between the flanges of the longitudinal members. The bar is then returned to its normal orientation.

The need to provide for differential thermal expansion of the bars and the framework, for any wearing away of the bearing members and for any wedging of debris from the combustible mass between the bars can lead to substantial variations in the actual width of the gaps between bars, over the axial dimension of the roller, especially where this is large. This disturbs the distribution of combustion-supporting air in the combustible mass.

According to the document EP-A-0 124 826 this disadvantage is alleviated and demounting of the roller is facilitated by dividing the rings into a plurality of groups and providing intermediate rings between the groups. These intermediate rings are formed of annular segment-shape parts with a first end bolted to a longitudinal member and the other end resting on the longitudinal member immediately to the rear. The second end is extended by a tenon which is trapped in a mortice provided at the first end of the contiguous intermediate member immediately to its rear. The intermediate members include at least one row of blowing orifices.

It will be understood that, when fitted, these intermediate parts limit the axial play of adjacent group of rings with which they are associated and that, when removed, they allow the bars to be turned slantwise sufficiently to demount them without interfering with the flanges. Nevertheless, this arrangement is not entirely satisfactory as within a group the play may still be cumulative. The blowing orifices provided in the intermediate parts are more likely to become clogged than the gaps between bars, their walls having no relative mobility. Finally, the intermediate members are long and locked cantilever-fashion at one end, forming an arch between two longitudinal members, which makes them fragile, all the more so in that they are necessarily subjected to cyclic and assymetric thermal and mechanical stresses.

To remedy these disadvantages the invention proposes a furnace grate roller intended mainly for incinerating refuse and comprising a cascade of rollers driven in rotation about parallel horizontal axes, the roller comprising a cylindrical cage framework with longitudinal members disposed between two flanges along generatrices regularly spaced around the periphery and a tubular casing formed by a plurality of groups of circular rings generally in planes perpendicular to the axis and in axial sequence from one flange to the other, gaps being provided between the rings for blowing combustion-supporting air, while the rings are segmented, comprising a plurality of arcuate bars which are mounted with play between two adjacent longitudinal members, and intermediate members associated with the respective groups of rings and fixed to the longitudinal members so as to limit relative axial movement of the bars in the groups, each intermediate member being fixed longitudinally to a longitudinal member over the axial dimension of a group of rings, between contiguous bar ends, the intermediate member and the contiguous bar ends having respective and complementary nesting configurations adapted to limit the relative movement of the bar ends in the axial, radial and peripheral directions.

The intermediate members are mounted longitudinally on the longitudinal members with no cantilever-like arrangement and are therefore protected against thermal stresses and mechanical impacts. The nesting shapes mean that each bar end contiguous with an intermediate member is held in a median position relative to the framework so that variations in the width of the gaps between rings are not cumulative and the distribution of combustion-supporting air remains correct.

There is preferably an even number of longitudinal members with a conventional T-shape cross-section profile. The bars then have the respective nesting shape at a first end and, at the second end, a notch in a web which fits over a longitudinal member flange; for each group of rings there is an intermediate member for each pair of longitudinal members.

In a preferred arrangement the intermediate members associated with the successive groups are alternately mounted on the two longitudinal members of a pair.

The intermediate members are preferably parallelepiped-shape with two lateral surfaces substantially parallel to the web of the longitudinal member and outside and inside surfaces parallel to the flanges, the nesting configuration in the case of the intermediate member consisting in bosses projecting from the lateral surfaces and progressively merging with the lateral walls, the bosses being disposed in sequence in a direction parallel to the axis with a pitch corresponding to the width of a ring plus that of a blow gap.

These bosses are preferably part-spherical. The first ends of the bars comprise complementary recesses at the corners of the flanges of the T-shape cross-section. The intermediate bosses on the intermediate member each occupy the contiguous recesses on two bars. At the corners of the intermediate member the bosses are each equivalent to half of an intermediate boss.

In a preferred arrangement the intermediate member is in two parts that can be superposed in the radial direction; a parallelepiped-shape "base" is fixed directly to the longitudinal member and facilitates the positioning of the bars during assembly; a "top" which carries the nesting bosses is then attached to it.

Further characteristics and the advantages of the invention will emerge from the following description given way by way of example and with reference to the appended drawings in which:

FIG. 1 is a schematic representation of a furnace grate formed by cascaded rollers;

FIG. 2 shows, partly in cross-section, the arrangement of a roller casing in accordance with the invention;

FIG. 3 shows, developed, a part of the casing in accordance with the invention, together with an intermediate member;

Figure 4:
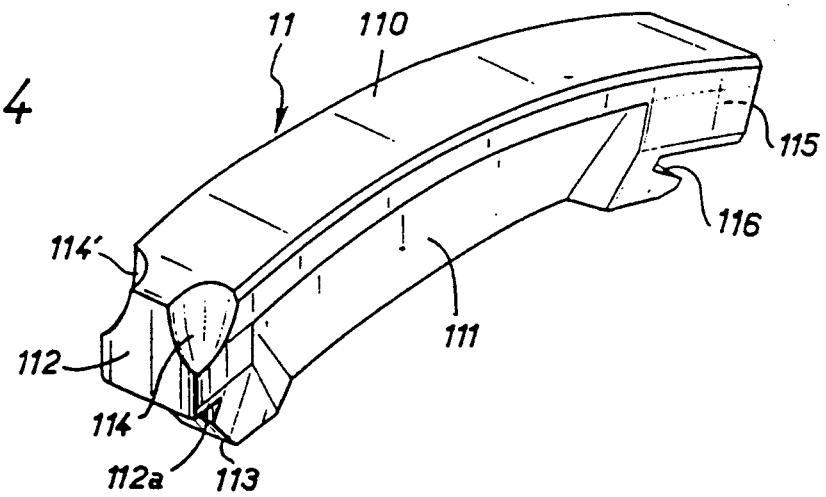
FIG. 4 is a perspective view of a grate bar.

As shown in FIG. 1 a roller furnace grate comprises a plurality of rollers 1, 2, 3, 4 in cascaded sequence along a downward slope with their shafts 1*b*, 2*b*, 3*b*, 4*b* parallel and equidistant. They rotate about their shafts in a direction (clockwise in this instance) such that the part of their periphery 1*a*, 2*a*, 3*a*, 4*a* which is at the top moves in the direction of the downward slope. Here the cascade is shown with four rollers to avoid overcomplicating the figure. In practise such cascades often comprise five or six rollers. The grate therefore forms a cascade, the solid combustible material, such as urban refuse, being tipped onto the top of the roller 1 while the ash and clinker are discharged by the bottom roller 4 towards an ash pit.

To support combustion air is blown in either from the sides or from below so as to be injected into the combustible mass through interstices provided in the periphery 1*a*, 2*a*, 3*a*, 4*a* of the rollers. To support the combustible mass and to allow the combustion-supporting air to pass through it the periphery of the rollers is, as schematically shown for the roller 1 in FIG. 1, provided with a refractory metal casing consisting of a succession of rings separated by gaps i (see FIG. 3) and running from one flange 1*c*, 2*c*, 3*c*, 4*c* of the roller to the other (not visible, not assigned a reference number). The construction and shape of the flanges are conventional and will not be described here.

Given that the casing is subjected to temperature cycles including heating in contact with the combustible mass and cooling during the part of the revolution between discharging onto the lower roller and reloading from the higher roller, the rings are attached with play to the roller support structure. Play is provided in three directions: axial, radial and peripheral.

To minimise axial sliding of the rings, leading to more or less complete elimination of some gaps i while others are widened, which would result in troublesome irregularities in the distribution of the combustion-supporting air, the rings are divided into groups G1, G2, G3 with associated intermediate members to limit axial sliding of the group of rings. Three groups of rings are shown to make the figure sufficiently detailed without overcomplicating it; this number is not imperative, of course.

The rings are in turn segmented along their periphery into arcuate bars attached by their ends to longitudinal structural members which form a cylindrical cage and extend from one flange 1*c*, 2*c*, 3*c*, 4*c* of the roller to the other. In a widely used prior art technique these longitudinal members have a T-shape profile in cross-section with a web in a plane passing through the axis of the roller and extending towards the roller axis and aligned flanges in a plane tangential to the periphery of the cage. In FIG. 2, which shows this prior art technique, the longitudinal members 10, 10', 10'', 10''' are seen in cross-section.

According to the document EP-A-0 124 826 the bars have a T-shape cross-section with flanges defining the external surface of the casing and a web directed towards the axis of the roller and lying in a plane perpendicular to that axis. Notches in the web at both ends of the bar are fitted around flanges of two adjacent longitudinal members. The intermediate members which keep the groups of bars independent are annular arcuate members bolted at one end to the flange of a longitudinal member and resting on the adjacent longitudinal member at the other end.

With this arrangement the bars are mounted before the intermediate rings are fitted, either by threading them over the longitudinal members from one end with the flange removed or by inserting them slantwise between the longitudinal members.

This prior art technique has been described in some detail because an object of the present invention is to improve upon this prior art arrangement, alleviating some of its disadvantages.

A first disadvantage results from the fact that the gaps between bars, which are kept at least to a minimal value by lateral bosses, represent an erratic distribution of the play within a group; all the play within a group can be cumulative at a particular gap, at which the flow of combustion-supporting air will be greatest. Also, the intermediate members are fastened cantilever-fashion by bolting them at one end, and can break as a result of the stresses imposed by the combustible materials and the assymetric heating, the effects of which are combined to a greater or lesser degree.

In the selected arrangement shown in FIGS. 2 and 3 there is an even number of longitudinal members 10, 10', 10'', 10''' at the periphery of the structural cage (in this instance the angular spacing between the longitudinal members is 45° ). The bars 11, 11', 11'', 11''', etc in peripheral sequence (FIG. 2) and 1.11, 1.11'; 2.11, 2.11'; 3.11, 3.11'; 4.11, 4.11'; 5.11, 5.11' in axial sequence within the group G are held at a first end 112 by an intermediate member 12 bolted longitudinally to the longitudinal member 10' and attached at their other end 115 by engaging a notch 116 over a flange of the longitudinal member 10, in an arrangement analogous to that of the prior art. It can be seen that the bars 11, 11', 11'', 11''', etc are disposed in sequence along the periphery of the ring, in alternately reversed positions, such that the bars adjoin in the ring either at their second end 115 or at their first end 112, to either side of an intermediate member 12.

As can be seen more clearly in FIG. 4, the bar has between its first end 112 and its second end 115 a T-shape cross-section with an external surface 110 which follows the casing cylinder and forms the flanges of the T-shape and a web 111 which forms a rib in the general plane of the ring of which the bar 11 forms part, perpendicularly to the axis of the roller.

The first end 112 of the bar 11 is shaped as an end face in a plane parallel to the plane of the web of the longitudinal member and is continued by a bearing surface 112*a* adapted to bear flat on the flange of the longitudinal member 10', (FIG. 2). At the two corners of the exterior surface 110 and the end surface 112 at the first end are formed quarter-hemisphere recesses 114 and 114', the center of the hemisphere being substantially located at the aforementioned (virtual) corner. Below the bearing surface 112*a* is an engagement bevel 113 which merges with the bearing surface 112 through a lip designed to abut against the edge of the longitudinal member flange.

The second end 115 is shaped as an end surface which overlies the attachment notch 116.

The bar 11 is inserted between the pair of longitudinal members 10, 10' by offering up the notch 116 at the second end 115 of the bar to the flange of the longitudinal member 10, placing the bearing surface 112*a* on the flange of the longitudinal member 10', and then fitting the intermediate member 12 in the manner explained after the following description of this part.

Figure 5:
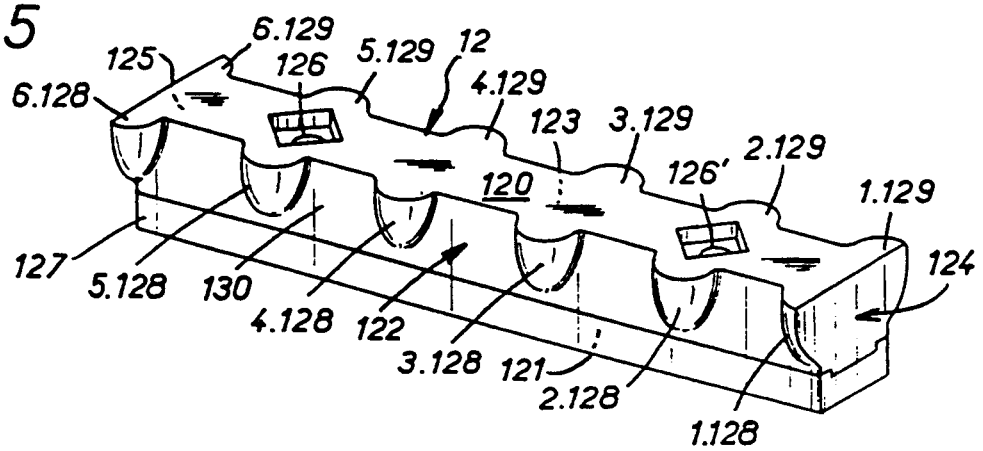
FIG. 5 is a perspective view of an intermediate member.

As shown in FIG. 5, the intermediate member is generally parallelepiped-shape with an outside surface 120 flush with the casing cylinder, an inside surface 121 designed to rest flat on the longitudinal member, outside and inside being understood in this context as meaning with reference to the grate roller, two lateral surfaces 121 and 122 corresponding to the end surfaces at the first end of the bar and two end surfaces 124 and 125. Bolts fixing the intermediate member 12 to the longitudinal member 10' pass through two holes 126 and 126' perpendicular to the outside surface 120 which open into this outside surface in square recesses for the bolt heads.

Projecting from the lateral surfaces 122 and 123 are twelve bosses 1.128, 2.128, 3.128, 4.128, 5.128, 6.128 and 1.129, 2.129, 3.129, 4.129, 5.129, 6.129 (in abbreviated form: (1-6).128, (1-6).129)), starting at the level of the outside surface 120 and progressively merging with the respective lateral surface.

It will be understood from FIG. 2 that the bosses are complementary to the recesses 114 and 114' in the end surfaces at the first end 112 of the bar. The intermediate bosses (2-5).128, (2-5).129 are half-hemisphere shape while the end bosses 1.128, 6.128, 1.129, 6.129 are quarter-hemisphere shape. The centers of the hemispheres are on the (virtual) corners between the top surface 120 and the lateral surfaces 122 and 123, and are disposed in longitudinal sequence with a pitch equal to the width of a bar 12 (in the direction parallel to the axis of the roller) plus the width of a gap i.

It will readily be understood that, ignoring the play, the intermediate member 12 determines the axial positions of the first ends of the bars relative to the longitudinal member. It is no longer possible for the play to accumulate at one gap. This intermediate member limits the relative movement of the bars 11 in the axial, radial and peripheral directions.

It will have been noted that the intermediate member 12 is made up of two superposed elements, a "base" 127 which rests on the longitudinal member 10' and a "top" 130.

At assembly time the base 127 is put in place first and fixed to the longitudinal member 10' and then the bars are put in place with the end surface 112 at the first end contiguous with the lateral surface of the base. The top 130 is then lowered into position so that its bosses are housed in the recesses 114, 114' in the bars and bolted into place.

FIGS. 2 and 3 show clearly that one intermediate member is used per group G of rings and per pair of longitudinal members 10, 10', which in this instance presupposes that there is an even number of longitudinal members.

Figure 6:
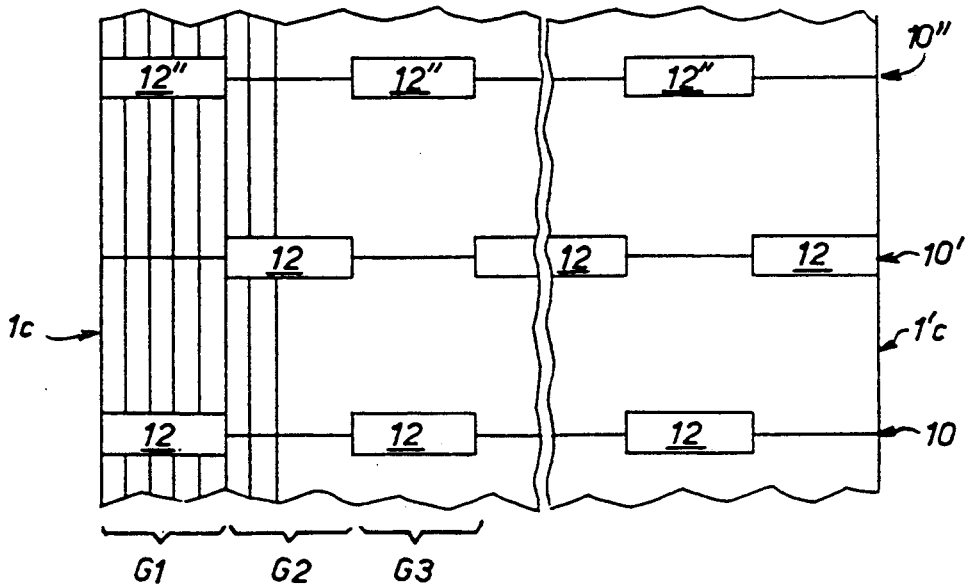
FIG. 6 shows, partially developed, one casing arrangement in accordance with the invention.

In the FIG. 6 arrangement it is seen that the intermediate members for each pair of longitudinal members are disposed alternately on the longitudinal members of the pair in the axial sequence of the groups of rings.

It goes without saying, however, that this arrangement is not imperative, although it prevents alignment of the second ends of the bars of more than one group, with the corresponding risk of the play accumulating.

Of course, the invention is not limited to the examples described but encompasses all variant executions thereof within the scope of the claims.

Thus it would be possible to provide intermediate members on all the longitudinal members, the bars having similar nesting configurations at both ends.

It is also possible to envisage other nesting configurations than the quarter-hemisphere configuration, with pyramid-shape projections, for example. Also, instead of projections on the intermediate members and recesses on the bars, flush with the outside surface of the casing, projections could be provided on the ends of the bars and recesses in the intermediate members, on the inside surface of the casing resting on the longitudinal members.

What we claim is:

1. Furnace grate roller intended mainly for incinerating refuse and comprising a cascade of rollers driven in rotation about parallel horizontal axes, each roller comprising a cylindrical cage framework, with longitudinal members disposed between two flanges along generatrices regularly spaced around the periphery and a tubular casing formed by a plurality of groups of circular rings generally in planes perpendicular to the axis and in axial sequence from one flange to the other, gaps being provided between the rings for blowing combustion-supporting air, while the rings are segmented, comprising a plurality of arcuate bars which are mounted with play between two adjacent longitudinal members, and intermediate members associated with the respective groups of rings and fixed to the longitudinal members so as to limit relative axial movement of the bars in the groups, each intermediate member being fixed longitdinally to a longitudinal member over the axial dimension of a group of rings, between contiguous bar ends, the intermediate member and the contiguous bar ends having respective and complementary nesting configurations adapted to limit the relative movement of the bar ends in the axial, radial and peripheral directions.

2. Roller according to claim 1 wherein each bar has a T-shape cross-section in a plane including the axis of the roller, each bar having a web forming a rib directed towards this axis and flanges defining the outside surface of the casing.

3. Roller according to claim 2 further comprising an even number of T-shape profile longitudinal members, each said longitudinal member having a web disposed in a plane including the axis of the roller and flanges in a common tangential plane, wherein each said bar comprises at a first end the respective nesting configuration and at a second end a notch in its said web adapted to be engaged over a said longitudinal member flange, one said intermediate member being associated with each pair of longitudinal members in each group of rings.

4. Roller according to claim 3 wherein the intermediate members associated with the successive groups are alternately mounted on the two longitudinal members of a pair.

5. Roller according to claim 3 wherein each intermediate member is generally parallelepiped-shape with two lateral surfaces substantially parallel to the web of the longitudinal member to which it is fixed and outside and inside surfaces parallel to the flanges of said longitudinal member, the nesting configuration being in the case of an intermediate member in the form of bosses projecting from the lateral surfaces and progressievely merging with the lateral surfaces, these bosses repeating in a direction parallel to the axis with a pitch corresponding to the width of a bar plus that of a blowing gap.

6. Roller according to claim 4 wherein each intermediate member is generally parallelepiped-shape with two lateral surfaces substantially parallel to the web of the longitudinal member to which it is fixed and outside and inside surfaces parallel to the flanges of said longitudinal member, the nesting configuration being in the case of an intermediate member in the form of bosses projecting from the lateral surfaces and progressively merging with the lateral surfaces, these bosses repeating in a direction parallel to the axis with a pitch corresponding to the width of a bar plus that of a blowing gap.

7. Roller according to claim 5 wherein the bosses are part-spherical.

8. Roller according to claim 5 wherein the first end of each bar incorporates recesses complementary to the bosses formed at the corners of the outside surface of the bar at the first end so that, within a group, two contiguous bar recesses are complementary with an intermediate boss on the intermediate member while the latter has corner bosses corresponding to half the intermediate bosses.

9. Roller according to claim 6 wherein the first end of each bar incorporates recesses complementary to the bosses formed at the corners of the outside surface of the bar at the first end so that, within a group, two contiguous bar recesses are complementary with an intermediate boss on the intermediate member while the latter has corner bosses corresponding to half the intermediate bosses.

10. Roller according to claim 5 wherein the intermediate member is in two parts that can be superposed in the radial direction, namely a base with plane lateral surfaces fixed directly to the longitudinal member and a top which is fixed to the base and carries the nesting bosses.

11. Roller according to claim 6 wherein the intermediate member is in two parts that can be superposed in the radial direction, namely a base with plane lateral surfaces fixed directly to the longitudinal member and a top which is fixed to the base and carries the nesting bosses.

12. Roller according to claim 7 wherein the intermediate member is in two parts that can be superposed in the radial direction, namely a base with plane lateral surfaces fixed directly to the longitudinal member and a top which is fixed to the base and carries the nesting bosses.

* * * * *